US009151491B2

(12) United States Patent
Kiener et al.

(10) Patent No.: US 9,151,491 B2
(45) Date of Patent: Oct. 6, 2015

(54) BURNER INSERTION AID FOR A BURNER, AND METHOD FOR INSERTING A BURNER

(75) Inventors: Christoph Kiener, München (DE); Matthias Köhler, Freiberg (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 339 days.

(21) Appl. No.: 13/699,034

(22) PCT Filed: Dec. 21, 2010

(86) PCT No.: PCT/EP2010/070340

§ 371 (c)(1), (2), (4) Date: Nov. 20, 2012

(87) PCT Pub. No.: WO2011/147489

PCT Pub. Date: Dec. 1, 2011

(65) Prior Publication Data

US 2013/0068315 A1 Mar. 21, 2013

(30) Foreign Application Priority Data

May 27, 2010 (DE) ..... 10 2010 021 726

(51) Int. Cl.

| | |
|---|---|
| ***F23D 11/36*** | (2006.01) |
| ***F23C 5/02*** | (2006.01) |
| ***F23M 5/02*** | (2006.01) |

(52) U.S. Cl.

CPC ..... *F23C 5/02* (2013.01); *F23M 5/025* (2013.01); *F23D 2900/00018* (2013.01); *Y10T 137/0402* (2015.04)

(58) Field of Classification Search

CPC ..... F23C 5/02; F23M 5/025; F23M 2900/05003; F23D 2900/00018; Y10Y 137/0402

See application file for complete search history.

(56) References Cited

U.S. PATENT DOCUMENTS

| | | | | |
|---|---|---|---|---|
| 5,551,867 | A * | 9/1996 | Shamp | 431/154 |
| 6,540,508 | B1 | 4/2003 | Simpson et al. | |

FOREIGN PATENT DOCUMENTS

| | | | |
|---|---|---|---|
| DE | 202009602954 | U1 | 5/2009 |
| EP | 0609972 | A1 | 8/1994 |
| FR | 2648898 | A1 | 12/1990 |
| JP | 2002013739 | A | 1/2002 |
| JP | 2003279002 | A | 10/2003 |

* cited by examiner

*Primary Examiner* — Alfred Basichas

(57) ABSTRACT

A burner insertion aid for a burner includes a funnel-shaped component, wherein the funnel-shaped component has foamed polymer and an outer edge for mounting on a burner fastening device and also has an inner funnel region for the insertion of a burner mouth.

12 Claims, 1 Drawing Sheet

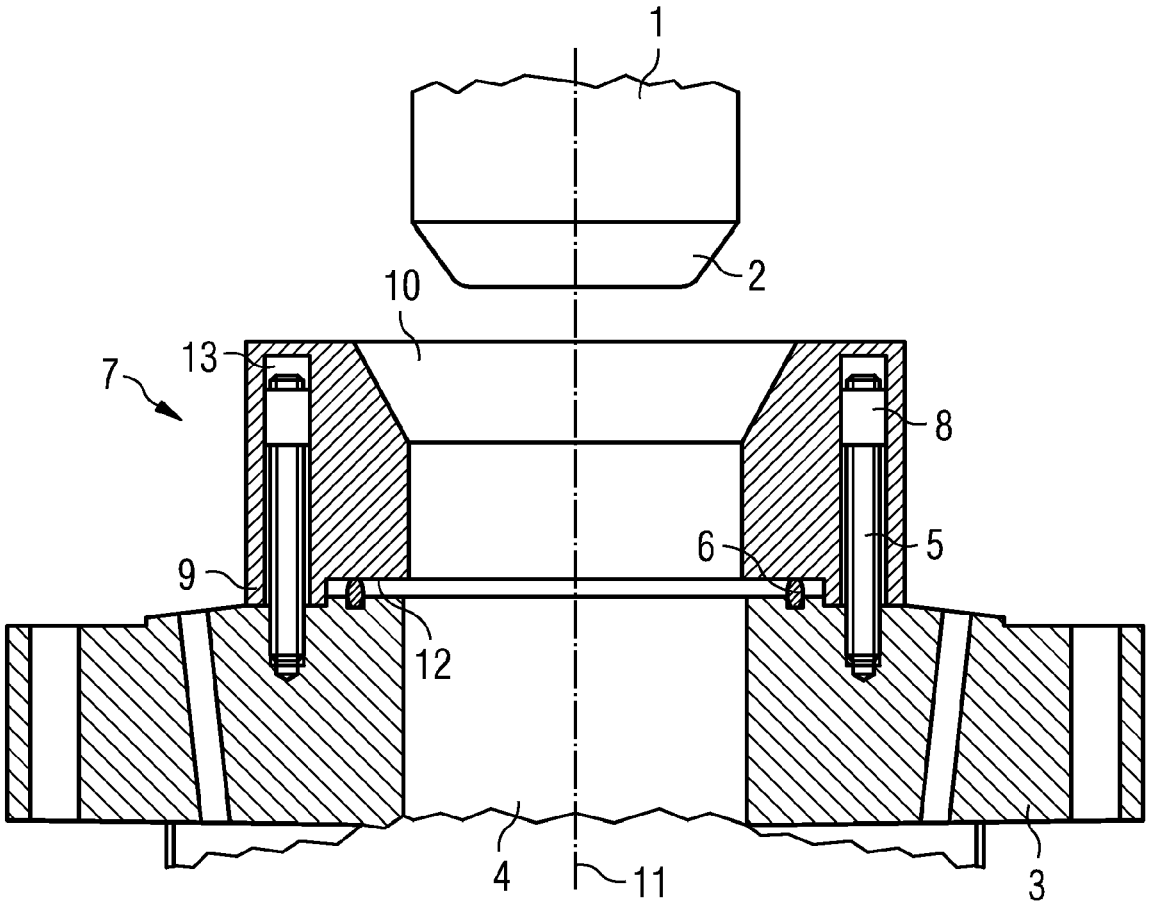
1
2
10
13
7
8
6
5
9
12
4
11
3

BURNER INSERTION AID FOR A BURNER, AND METHOD FOR INSERTING A BURNER

CROSS REFERENCE TO RELATED APPLICATIONS

This application is the US National Stage of International Application No. PCT/EP2010/070340 filed Dec. 21, 2010, and claims the benefit thereof. The International Application claims the benefits of German Patent Application No. 10 2010 021 726.3 DE filed May 27, 2010. All of the applications are incorporated by reference herein in their entirety.

FIELD OF INVENTION

The invention relates in general to a burner insertion aid for a burner and to a method for inserting a burner, and in particular to the insertion of a burner into a gasification plant.

BACKGROUND OF INVENTION

A burner, in particular for gasification plants, for example from Siemens Fuel Gasification Technology GmbH & Co. KG, is a sensitive component. With a mass of about 5 tones and an overall length of about 5 meters, the wall thickness in the region of the burner mouth is only 3 mm; behind it there are cooling surfaces through which water flows and a displacement body which regulates the water flow. The width of these cooling channels and the homogeneous coolant flow must necessarily be ensured during operation, since otherwise the heat introduced from the gasification space cannot be discharged correctly, which leads to thermal damage or destruction of the burner and due to this a production outage for the customer.

When moving and handling the burner, it is therefore strictly necessary to ensure that the region of the burner mouth is not mechanically damaged by impact. In particular when inserting the burner into the open flange of the burner support unit (BSU) and when inserting the burner into its transport container, it is necessary to ensure that impact on the screw bolts and further parts is avoided.

The current solution is careful and attentive handling of the burner by trained personnel. Burners of this size in the 500 MW class, however, are new devices hand have not yet been used.

SUMMARY OF INVENTION

It is an object to simplify the insertion of a burner.

This object is achieved by a burner and a method as claimed in the independent claims Embodiments are defined in the dependent claims.

According to a first aspect, the invention relates to a burner insertion aid for a burner, comprising a funnel-shaped component, wherein the funnel-shaped component comprises foamed polymer and an outer edge for mounting on a burner support unit as well as an inner funnel region for the introduction of a burner mouth.

In order to protect the burner, the burner mouth must not touch any sharp and/or hard objects and components; specifically, mechanical point force actions are particularly damaging. Furthermore, the burner should be guided during its insertion, in order to permit straightforward positioning. By using shaped parts made of foamed polymers, these requirements can be satisfied according to the invention in one component. When configured in the form of a funnel, a component consisting of foamed polymer meets the requirements for guidance of the burner without the possibility of damage occurring.

According to the invention, the use of foamed plastic material is proposed, which simultaneously satisfies a plurality of requirements and offers many advantages. As regards the geometry, the funnel is used as a guide. Contact protection is provided and damage cannot take place because the soft foam provides protection. The weight allows easy handleability on the installation site. The price is low since the material is inexpensive. Lastly, geometrical precision is ensured, which allows the use of a replaceable disposable part.

Optionally, the component may be configured as a disposable part, in this way an always clean and identically shaped part is available. This makes it possible to maintain oil- and grease-free conditions on the burner.

Recesses for burner fastening screws or screw bolts of the burner flange may be provided in the outer edge, so that impact of the burner mouth on these components is prevented. This protects the burner and in this way also the screw threads of the screw bolts against damage. Furthermore, the burner insertion aid may be fastened with the recesses and burner fastening screws.

The funnel-shaped component may comprise foamed polyolefins, in particular foamed/expanded polyethylene or polypropylene. This foam cannot crumble and is not susceptible to wear. It has a low density, is easy to transport on the installation site and can be produced economically.

The component may have the shape of a circular ring. This allows a one-piece burner insertion aid, which is simple to produce and handle.

The component may have the shape of one or more circular ring segments. The circular ring segments may be connected and the component may comprise one or more intended fracture points for separation of the component after it has been used.

Embodiments as a component in the form of a circular ring, as two half-shells or as a plurality of circular ring segments are possible. In the case of producing disposable half-shells or disposable circular ring segments, these circular ring segments may also be connected to one another during use of the burner insertion aid and the burner may be separated reversibly or irreversibly for its removal, for example in the case of a disposable part by breaking at intended fracture points.

The component may have a recess in the outer edge for a seal of the burner support unit. This makes it possible to protect the seal, since it is not exposed to any bearing force by the burner insertion aid.

According to another aspect, the invention relates to a method for inserting a burner into a burner support unit, having the following steps:

- introducing a burner mouth into the burner support unit with the assistance of a burner insertion aid, the burner insertion aid having a funnel-shaped component comprising foamed polymer;
- removing the burner insertion aid.

With the burner insertion aid, the method offers a simple solution for insertion of the burner, independent of the presence of experienced personnel. The advantages and modifications described above likewise apply for the method.

The burner insertion aid may be arranged on the burner support unit in a first step. The burner insertion aid may also already be arranged on the burner support unit during production of the latter.

The burner insertion aid may be mounted on burner fastening screws. In this way, both the burner insertion aid and the burner fastening screws are protected against damage. Simultaneously, the burner fastening screws can be used as a guide and as fastening for the burner insertion aid.

The burner mouth may be guided by an inner funnel of the burner insertion aid. Besides protection of the burner mouth, this also allows simple and expedient introduction of the burner mouth into the burner support unit.

The burner insertion aid may be separated reversibly and/or irreversibly for its removal. Separation of the burner insertion aid facilitates removal from the burner support unit. Reversible separation allows reuse of the burner insertion aid. Irreversible separation is carried out in the case of a disposable burner insertion aid. A combination is also possible. In this case, a certain part of the burner insertion aid is reused, while another part of the burner insertion aid is only used once. For example, regions of the burner insertion aid which come in contact with the burner mouth may be used only once.

BRIEF DESCRIPTION OF THE DRAWINGS

The invention will be described in more detail below with the aid of the drawing.

The sole FIGURE shows a sectional representation of a burner support unit and a burner insertion aid according to the invention.

The drawings merely serve to explain the invention and do not restrict it. The drawings and the individual parts are not necessarily true to scale. References which are the same denote parts which are the same or similar.

DETAILED DESCRIPTION OF INVENTION

The FIGURE shows a small section of a burner 1 with its burner mouth 2. The burner 1 is arranged above a burner support unit 3, with which the burner 1 is fastened in a gasification plant (not shown).

The burner support unit 3 has the form of a flange with a central opening 4 for receiving the burner 1. On an upper side, which forms an outer side in the installed state of the burner support unit 3, a plurality of burner fastening screws 5 are arranged circularly around the opening 4. By means of the burner fastening screws or screw bolts 5, the burner 1 is fastened on the burner support unit 3. Two or more burner fastening screws 5 may be provided. Arranged around the opening 4, there is at least one seal 6 which seals the burner 1 and the burner support unit 3 from one another in the installed state.

According to the invention, the burner 1 is inserted into the burner support unit 3 by using a burner insertion aid 7. The burner insertion aid 7 comprises a funnel-shaped component 8, which comprises foamed polymer such as foamed polyolefins, in particular foamed/expanded polyethylene or polypropylene. The component 8 may consist either partially or entirely of the described materials.

The component 8 has an outer edge 9, which is mounted on the burner support unit 3. Furthermore, the component 8 has an inner funnel 10 with a widened region for introduction and centering of the burner mouth 2, and a subsequent straight region which merges into the opening 4 of the burner support unit 3. The expressions inner and outer refer to the radial position with respect to a symmetry axis 11.

The component 8 is rotationally symmetric in its outer and inner shapes, which facilitates both production and fastening of the burner insertion aid 7 on the burner support unit 3.

On a lower side of the component 8, facing away from the widened funnel region, it has a recess 12 for the seal 6. The recess 12 may be dimensioned in such a way that the seal 6 is not exposed to any damaging forces. The recess 12 is arranged in the outer edge 9, or delimits the outer edge 5 in the direction toward the symmetry axis 11. The recess 12 may be either circular, as represented, or annular, in which case the width of the ring is sufficient to receive the seal 6.

The component 8 comprises further recesses 13, which are used to receive the burner fastening screws 5. The number of recesses 13 corresponds at least to the number of burner fastening screws 5.

It is also possible that the recess 12 for the seal 6 and the recesses 13 for the burner fastening screws 5 merge into one another so that, depending on the definition, there is a single large recess for the seal 6 and the burner fastening screws 5, or there are a plurality of recesses as described above.

The component 8 essentially has the shape of a circular ring comprising the inner funnel 10. Either the component 8 may be formed in one piece as a circular ring or it may consist of a plurality of circular ring segments. For example, the component 8 may consist of two half-shells, i.e. two circular ring segments each covering about 180°. The component 8 may also consist of a multiplicity of circular ring segments having a correspondingly smaller angular coverage. The total angular coverage of the circular ring segments may be less than 360°, i.e. there may be gaps between the individual circular ring segments.

The circular ring segments may be separated from one another or connected to one another. The connection may be carried out by using aids, for example pins or flexible means such as bands. It is also possible, for example, to provide the component 8 with intended fracture points which then connect circular ring segments to one another in an operating state and separate the circular ring segments from one another in a state in which they are taken apart from one another.

The insertion of the burner 1 into the burner support unit 3 will be described below. First, the burner insertion aid 7 is fastened on the burner support unit 3. To this end, the burner insertion aid is mounted on the burner fastening screws 5 by means of the recesses 13. In this case, the burner insertion aid 7 is fixed on the burner support unit 3 in such a way that the inner funnel 10 and the opening 4 are aligned with one another. Simultaneously, both the burner mouth 2, or the burner 1, and the burner fastening screws 5 are safeguarded against contact and therefore damage. The seal 6 then lies in the recess 12.

As an alternative, the burner insertion aid 7 may be a part of the burner support unit 3. This means that the burner insertion aid 7 is not mounted before inserting the burner 1, but instead is already fastened on the burner support unit 3.

After this preparation, the burner 1 is now introduced into the opening 4 of the burner support unit 3 by means of the burner insertion aid 7. First, the burner mouth 2 is inserted into the widened funnel opening or funnel mouth of the inner funnel 10 of the burner insertion aid 7. The funnel-shaped interior of the component 8 allows simplified insertion of the burner mouth 2 owing to the widened and subsequently narrowing funnel opening. Simultaneously, the soft material of the component 8 protects the sensitive burner mouth 2 against damage. Possible damage to the burner mouth 2 and/or the burner fastening screws 5 is prevented by the coverage of the burner fastening screws 5 by means of the component 8.

After the burner 1 has now been centered with the aid of the funnel, it is introduced through the burner insertion aid 7 and subsequently the opening 4 into the burner support unit 3.

The burner insertion aid 7 can now be removed, since the sensitive burner mouth 2 is already inside the opening 4 or already on the far side of the opening 4, and there is no further risk of damage.

For the removal of the burner insertion aid 7, the component 8 is for example disassembled along intended fracture points and removed from the burner support unit 3. The burner 1 is now fully introduced into the burner support unit 3 and fastened with the aid of the burner fastening screws 5.

During replacement or removal of the burner 1, for example due to maintenance or upgrading, after partial removal of the burner 1, when enough space is available for the burner insertion aid 7, a new burner insertion aid 7 may be used in order to protect the burner 1, in particular the burner mouth 2, against damage when extracting the burner 1. Of course, the burner insertion aid 7 used for the installation of the burner 1, or parts thereof, may also be used for the extraction of the burner 1.

The invention claimed is:

1. A burner insertion aid for a burner, comprising:

a funnel-shaped component, wherein the funnel-shaped component comprises:

a foamed polymer and an outer edge for mounting on a burner support unit;

an inner funnel region for introducing a burner mouth; and one or more intended fracture points for separation of the component from the burner support unit after the component has been used wherein the component is in a form of one or more connected circular ring segments.

2. The burner insertion aid as claimed in claim 1, wherein recesses for burner fastening screws are provided within an interior portion of the outer edge of the funnel-shaped component.

3. The burner insertion aid as claimed in claim 1, wherein the funnel-shaped component comprises foamed polyolefins.

4. The burner insertion aid as claimed in claim 3, wherein the polyolefins comprise foamed and/or expanded polyethylene or polypropylene.

5. The burner insertion aid as claimed in claim 1, wherein the funnel-shaped component has the shape of a circular ring.

6. The burner insertion aid as claimed in claim 1, wherein the body consists entirely of the foamed polymer.

7. The burner insertion aid as claimed in claim 1, wherein the funnel-shaped component has a further recess in the outer edge for receiving a seal of the burner support unit.

8. A method for inserting a burner into a burner support unit, comprising:

providing a burner insertion aid comprising a funnel-shaped component with foamed polymer;

introducing a burner mouth of the burner through the burner insertion aid and into an opening of the burner support unit using the burner insertion aid; and removing the burner insertion aid to leave behind the burner inserted within the burner support unit.

9. The method as claimed in claim 8, wherein the burner insertion aid is arranged on the burner support unit in a first step.

10. The method as claimed in claim 8, wherein the burner insertion aid is mounted on burner fastening screws.

11. The method as claimed in claim 8, wherein the burner mouth is guided by the inner funnel-shaped cavity of the burner insertion aid during the introducing.

12. The method as claimed in claim 8, wherein the burner insertion aid is separated reversibly and/or irreversibly for a removal of the burner insertion aid.

* * * * *